US007529380B2

(12) United States Patent
Ueda et al.

(10) Patent No.: US 7,529,380 B2
(45) Date of Patent: May 5, 2009

(54) MULTIFUNCTION-TYPE VIBRATION ACTUATOR AND MOBILE TERMINAL DEVICE

(75) Inventors: Minoru Ueda, Tokyo (JP); Shoichi Kaneda, Tokyo (JP); Kenji Ueno, Tokyo (JP)

(73) Assignee: Namiki Seimitsu Houseki, Tokyo (JP)

( * ) Notice: Subject to any disclaimer, the term of this patent is extended or adjusted under 35 U.S.C. 154(b) by 292 days.

(21) Appl. No.: 10/592,957

(22) PCT Filed: Mar. 18, 2005

(86) PCT No.: PCT/JP2005/004909

§ 371 (c)(1),
(2), (4) Date: Sep. 15, 2006

(87) PCT Pub. No.: WO2005/091673

PCT Pub. Date: Sep. 29, 2005

(65) Prior Publication Data

US 2007/0274543 A1 Nov. 29, 2007

(30) Foreign Application Priority Data

Mar. 22, 2004 (JP) ..... 2004-082328

(51) Int. Cl.
*H04R 25/00* (2006.01)

(52) U.S. Cl. ..... 381/398; 381/396; 381/423

(58) Field of Classification Search ..... 381/386, 381/396, 398, 400, 401, 402, 412, 423, 424, 381/430, 433, 406; 181/171, 172, 173
See application file for complete search history.

(56) References Cited

U.S. PATENT DOCUMENTS 6,529,611 B2 * 3/2003 Kobayashi et al. ..... 381/396

(Continued)

FOREIGN PATENT DOCUMENTS

JP 9-327088 12/1997

(Continued)

OTHER PUBLICATIONS

International Search Report dated Jun. 28, 2005 Application No. PCT/JP2005/004909.

*Primary Examiner*—Huyen D Le
(74) *Attorney, Agent, or Firm*—Studebaker & Brackett PC; Donald R. Studebaker

(57) ABSTRACT

A multifunction-type vibration actuator and a mobile terminal device capable of decreasing the lowest acoustic resonance frequency and preventing breakage of a coil lead as well as improving acoustic characteristics and preventing sound leaks. A portion near the outer periphery of a diaphragm 3 is bent to form a rising portion 3*b* extending along an inner periphery 1*a* of a housing 1 toward an open end thereof. This rising portion 3*b* serves as a corrugation to decrease the lowest resonance frequency and the amplitude of vibration of which a fulcrum is served by the rising portion 3*b* is not so large as that of the corrugation. Accordingly, the coil lead of a voice coil 4 is not easily broken. Furthermore, an extending portion 3*c* is formed to extend outward along a flat surface 1*b* formed at the open end of a housing 1 from a rising portion 3*b*. This enlarges the entire radius of the diaphragm 3 and improves the acoustic characteristics. Moreover, by arranging a flat surface 1*b* of a housing 1 parallel to an extending portion 3*c* of a diaphragm 3, a gasket can easily be attached.

2 Claims, 3 Drawing Sheets

U.S. PATENT DOCUMENTS

| | | | | |
|---|---|---|---|---|
| 6,611,605 | B2 * | 8/2003 | Kim | 381/406 |
| 6,996,246 | B2 * | 2/2006 | Ito | 381/398 |
| 7,043,045 | B2 * | 5/2006 | Takahashi | 381/398 |

FOREIGN PATENT DOCUMENTS

| | | |
|---|---|---|
| JP | 10-145891 | 5/1998 |
| JP | 2001-359193 | 12/2001 |
| JP | 2002-191092 | 7/2002 |
| JP | 2003-248691 | 12/2003 |
| WO | WO 03/101148 | 4/2003 |

* cited by examiner

MULTIFUNCTION-TYPE VIBRATION ACTUATOR AND MOBILE TERMINAL DEVICE

TECHNICAL FIELD

This invention relates to a multifunction-type vibration actuator mounted on a mobile terminal device, such as a mobile phone and a small information communication terminal, and alerts a user to an incoming call with sound or vibration from one device and a mobile terminal device mounted with that actuator. More specifically, this invention relates to a multifunction-type vibration actuator in a housing assembled with a magnetic circuit part, a diaphragm facing this magnetic circuit part, a voice coil fixed to this diaphragm and inserted into a magnetic gap of the magnetic circuit part, and a suspension for supporting the magnetic circuit part, and an outer periphery of the diaphragm is fixed to an open end of the housing to cover the housing.

BACKGROUND ART

Conventionally, this type of multifunction-type vibration actuator has an outer periphery of a diaphragm contacts a stepped section formed at an open end of a housing bonded on the stepped section, one surface of a voice coil is bonded to a back face of an annular mounting section formed in the center of the diaphragm supported by the back face and is inserted into a magnetic gap of a magnetic circuit part, lead wires of this voice coil are adhesively attached to the back face of the diaphragm, and the ends of the lead wires are electrically connected to a terminal plate (power supply terminal) provided on the outside of the diaphragm (see, for example, Patent Reference 1). In this actuator, transmission of a voice signal to the voice coil fixed to the diaphragm initiates vibration of the diaphragm to generate sound, such as an incoming call alert, a melody, voice or music, and transmission of a signal with a vibration frequency initiates vibration of a mechanical vibration system consisting of the magnetic circuit part and a suspension to transmit this vibration throughout a mobile terminal device mounted with this multifunction-type vibration actuator through the housing.

[Patent Reference] JP2002-191092A (FIGS. 2-3 and 6 on pages 2-4)

DISCLOSURE OF THE INVENTION

Problem Solved by the Invention

In this type of multifunction-type vibration actuator, size reduction is promoted and specifications equivalent to a conventional larger actuator is required at the same time. Since significant difficulty in obtaining the necessary acoustic characteristics results from fixation of a diaphragm using conventional technology, the development of new method for fixing the diaphragm is required. More specifically, the conventional method of fixation has the following problems:

1. Decreasing the lowest resonance frequency ($f_0$: f zero) by providing the diaphragm with corrugation results in larger amplitude associated with vibration of the diaphragm. Therefore, the lead wires of a voice coil bonded to an inner surface of the diaphragm are easily broken, leading to poor durability.

2. The outer periphery of the diaphragm bonded to a stepped section of the diaphragm decreases a radius of the whole diaphragm, leading to difficulty in obtaining the necessary acoustic characteristics.

3. Putting a gasket, such as a sponge, between the diaphragm and an open end of the housing for the purpose of preventing sound leakage as required results in difficulty in bonding the gasket because the open end of the conventional housing has a stepped portion.

This invention solves the above problems and provides a multifunction-type vibration actuator and a mobile terminal device that simultaneously realize a decrease in the lowest resonance frequency and prevention of coil lead wire breakage, improve acoustic characteristics, and provide a technique for easily preventing sound leakage.

Means for Solving the Problem

In order to achieve the aforementioned purposes, the invention according to claim 1 provides a multifunction-type vibration actuator, wherein a portion close to the outer periphery of the diaphragm is bent along an inner periphery of the housing to form a rising portion extending toward the open end, an extending surface extending outward along a flat surface formed at the open end of the housing from the rising portion is formed by bending, and the flat surface of the housing and the extending surface of the diaphragm are arranged and bonded so as to be parallel while facing each other.

The invention according to claim 2 provides a mobile terminal device incorporating the multifunction-type vibration actuator according to claim 1, wherein a received call-out signal initiates vibration of one or both mechanical vibration systems consisting of the diaphragm, the magnetic circuit part, and the suspension, and vibration of the mechanical vibration systems is transmitted throughout the device through the housing, and reset of the call-out signal stops vibration of the housing and the mechanical vibration systems.

Effects of the Invention

In this invention, a portion of a diaphragm close to an outer periphery thereof is bent at an angle of approximately 90-110 degrees to form a rising portion extending toward an opening end along an inner periphery of a housing, enabling a decrease in the lowest resonance frequency ($f_0$: f zero) because this rising portion serves as corrugation. At the same time, since the amplitude of the vibration of which a fulcrum is served by the proximal end of the rising portion is not high in comparison with that of the corrugation, breakage of lead wires of a voice coil can be prevented even at high amplitude, leading to high durability. Furthermore, formation of an extending portion extending outward along a flat surface formed at an open end of the housing from this rising portion increases a radius of a whole vibration plate to improve acoustic characteristics. By making the flat surface of the housing face parallel to the extending portion of the diaphragm, a gasket, such as a sponge, can be bonded to prevent sound leakage.

BEST MODE FOR CARRYING OUT THE INVENTION

A multifunction-type vibration actuator A according to this invention comprises a housing 1, a magnetic circuit part 2 inside a housing 1, a diaphragm 3 facing a magnetic circuit part 2, a voice coil 4 fixed to a diaphragm 3 and inserted into an annular magnetic gap 2*a* of a magnetic circuit part 2, and a suspension 5 for supporting the magnetic circuit part, wherein entry of a voice signal into a voice coil 4 initiates a small vibration of a diaphragm 3 to generate a sound, such as an incoming call alert, a melody, voice, and music, and the flow of signal current at a vibration frequency of 120-160 Hz initiates the large vibration of a mechanical vibration system with a weight including a magnetic circuit part 2 and a suspension 5 as shown in FIGS. 1 and 4.

Embodiments of this invention are described using diagrams.

Embodiment 1

In embodiment 1, a flat annular mounting section 3*a* is formed in a diaphragm 3 almost in the middle between the center of a diaphragm 3 and the outer periphery of a diaphragm 3, the portion close to the outer periphery of a diaphragm 3 is bent in parallel with and along an inner peripheral surface 1*a* to form an annular rising portion 3*b* extending toward an open end of a housing 1, an extending section 3*c* extending outward from this rising portion 3*b* along a flat surface 1*b* formed at the open end of a housing 1, and a flat surface 1*b* of a housing 1 is allowed to face and be parallel with an extending section 3*c* of a diaphragm 3 to be fixed to each other.

This diaphragm 3 is a vibration plate formed as a circular plate with an appropriate thickness made from an elastic material of plastic film, such as polycarbonate, polyetherimide, polyimide, and polyethylene terephthalate. The open end of a voice coil 4 is bonded to a back face of the annular mounting portion 3*a* formed almost in the middle between the center of a diaphragm 3 and the outer periphery of a diaphragm 3 with adhesive, a voice coil 4 is inserted into a magnetic gap 2*a*, and further concentric curved surfaces 3*d* and 3*e* are formed by bending at the center and the outer periphery of a coil mounting portion 3*a* as shown in FIGS. 1 through 3.

A voice coil 4 is cylindrically wound of which lead wires 4*a* are bonded on the back face of a diaphragm 3 with adhesive to avoid the effects of vibration as shown in FIG. 2. The distal ends of these lead wires 4*a* are pulled out toward a terminal block 1*c* provided to the outside of a housing 1 and are electrically connected to a terminal plate 6 provided to a terminal block 1*c* by soldering or bonding.

A housing 1 is a cylindrical enclosure for accommodating the above-described magnetic circuit part 2. One open end of a housing 1 is provided with a flat surface 1*b* on which an extending portion 3*c* of a diaphragm 3 is bonded with adhesive. Another open end 1*d* is detachably installed and covered with a cylindrical bottom cover 7 having a bottom. An inner periphery 1*a* of a housing 1 is provided with an annular overhang wall 1*e* to be in contact with a magnetic circuit part 2 during vibration. Another open end 1*d* extending from this inner periphery 1*a* is provided with a retaining means for supporting an outer end section 5*c* of a suspension 5.

A suspension 5 is formed as an annular leaf spring of which a central part is provided with a central opening 5*a* to be fitted with a magnetic circuit part 2 to be described later, an annular section 5*b* surrounding this central opening 5*a* and in contact with a magnetic circuit part 2, and an arm 5*d* elastically deformed while communicating an annular section 5*b* and an outer end section 5*c*. An annular section 5*b* is integrally bonded to a magnetic circuit part 2 with adhesive or by laser welding and an outer end section 5*c* is installed on the other open end 1*d* of a housing 1 with the aforementioned fixing means to support a magnetic circuit part 2 at a position facing a diaphragm 3.

In this embodiment, as a fixing means for immobily supporting an outer end section 5*c* of a suspension 5, an outer end section 5*c* of this suspension 5 is annularly formed, the upper surface thereof is in contact with the other open end 1*d* of a housing 1, and an annular elastic body 8, such as an O-ring, is inserted between the bottom of an annular outer end section 5*c* and a bottom cover 7 covering the other open end 1*d* of a housing 1 to retain a housing 1 and an outer end section 5*c* of a suspension 5.

A magnetic circuit part 2 is configured by concentrically stacking a yoke 9, a disk-shaped magnet 10, and a disk-shaped pole piece 11.

A yoke 9 is made of a magnetic material and formed as a cylinder with a bottom. An outer peripheral surface 9*a* of a yoke 9 is formed to provide a small gap (for example, 0.05-0.2 mm) with an inner peripheral surface 1*a* of a housing 1. A contact section 9*b* facing an annular overhang wall 1*e* formed in an inner peripheral surface 1*a* of a housing 1 is provided in contact with the annular overhang wall 1*e* of a housing 1 during vibration of a magnetic circuit part 2 to restrict movement of a magnetic circuit part 2 caused by an external shock force.

Furthermore in this embodiment, the bottom of a yoke 9 is provided with a raised surface 9*c* fitting into a central opening 5*a* of a suspension 5, and an annular section 5*b* of a suspension 5 is in contact with and integrally bonded to a support surface 9*d* formed around the raised surface 9*c* with adhesive or by laser welding. A counter bore (not illustrated) with a diameter slightly larger than that of a magnet 10 can be provided in order to position a magnet 10 at the center of the bottom if necessary.

A pole piece 11 is formed as a disk with a diameter equal to or larger than that of a magnet 10. The bottom of a pole piece 11 can be provided with a counter bore (not illustrated) with a diameter slightly larger than that of a magnet 10 in order to position a magnet 10 if necessary. It is preferable that a magnet 10 is retained between this counter bore and the counter bore of a yoke 9 to restrict a radial shift of a magnet 10.

Now, performance of such multifunction-type vibration actuator A is described. Application of a voice signal current from a terminal plate 6 through a lead wire 4*a* allows a voice coil 4 to generate an electromagnetic force acting on a yoke 9, magnet 10, and pole piece 11 of a magnetic circuit part 2 to repeat magnetic attraction and repulsion between them and to start vibration according to the Fleming's left hand rule. In association with this, the curved surfaces of 3*d* and 3*e* of a diaphragm 3 bonded with a voice coil 4 start vibration of a fulcrum of which is served by a lower end 3*b*' of the rising portion 3*b*.

The small vibration of this diaphragm 3 generates an incoming call alert, melody, voice, and music. A suspension 5, however, seldom vibrates because of a different natural frequency.

Vibration of a diaphragm 3 at this voice signal generation enables a decrease in the lowest resonance frequency ($F_0$: f zero) because this rising portion 3*b* serves as usual corrugation. At the same time, since an amplitude of vibration of which a fulcrum is served by a lower end 3*b*' of a rising portion 3*b* is not as high as the usual corrugation, a lead wire 4*a* from a voice coil 4 routed along a diaphragm 3 can avoid breakage even if the amplitude is increased. In addition, substantial enlargement of a radius of a whole vibration plate by an extending section 3*c* extending outward from this rising portion 3*b* improves the acoustic characteristics.

On the other hand, when a signal applied to a voice coil 4 has a vibration frequency (for example, 120-160 Hz), a diaphragm 3 seldom vibrates, which reduces sound volume. On the other hand, vibration of a magnetic circuit part 2 supported by a suspension 5 increases.

Since a mechanical vibration system consisting of a magnetic circuit part 2 and a suspension 5 provides high vibration energy dependent on its large mass, the generated vibration is transmitted to the whole mobile terminal device (not illustrated) mounted with a multifunction-type vibration actuator A through a housing 1 to alert a user to an incoming call. Thus, one sound production structure provides two types of action: sound production and vibration.

Embodiment 2

In this embodiment 2, an annular mounting section 3*a* with a rectangular cross-section and an open top is partially formed at a position almost in the middle between the center and the outer periphery of a diaphragm 3, a voice coil is installed on a flat surface thereof, a portion close to the outer periphery of this diaphragm 3 is obliquely bent along an inner peripheral surface 1*a* of a housing 1 to form an annular rising portion 3*b* extending toward an open end of the housing 3, and an extending section 3*c* extending outward from this rising portion 3*b* along a flat surface 1*b* is formed at an open end of a housing 1 as shown in FIG. 4. Except for these configurations, the embodiment 2 is identical to the embodiment 1 shown in FIGS. 1 through 3.

Therefore the embodiment 2 shown in FIG. 4 produces operational effects similar to those of the embodiment 1 shown in FIGS. 1 through 3.

In addition, in this embodiment 2, tongues (not illustrated) circumferentially and equally spaced are provided to the outer peripheral section 5*c* of a suspension 5 as a retaining means for supporting an outer end section 5*c* of a suspension 5 as disclosed by JP2002-191092A. By inserting and bonding these tongues in notches (not illustrated) formed in the inner peripheral surface of a housing 1, a magnetic circuit part 2 is elastically supported by a housing 1 through a suspension 5 in a hanging condition.

The shape of the above-described diaphragm 3 is not limited to the illustrated example. If the shape has at least a rising portion 3*b* and an extending portion 3*c*, a modification is acceptable. Moreover, the configuration and shape consisting of a housing 1, a magnetic circuit part 2, a voice coil 4 and a suspension 5 are not limited to those illustrated. If functions similar to those described above are satisfied, other configurations and shapes are acceptable.

DESCRIPTION OF REFERENCE CHARACTERS

Figure 1:
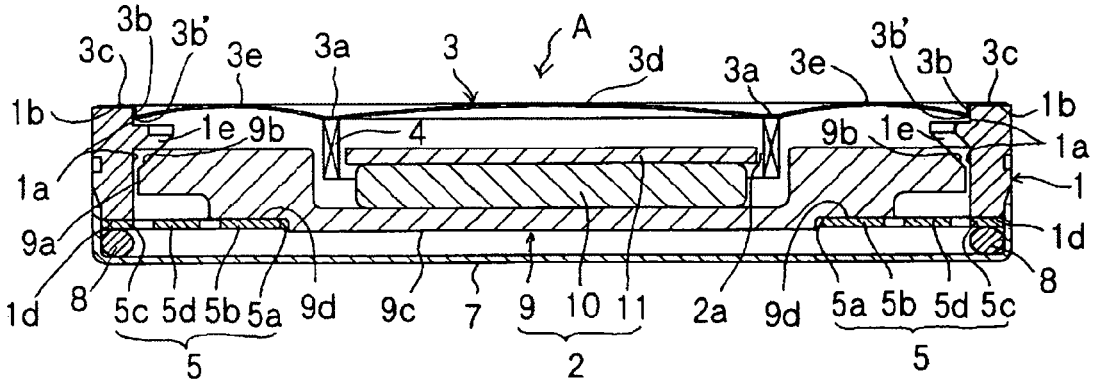
FIG. 1 is a cross-sectional front view of a multifunction-type vibration actuator showing one embodiment according to the invention.
Figure 2:
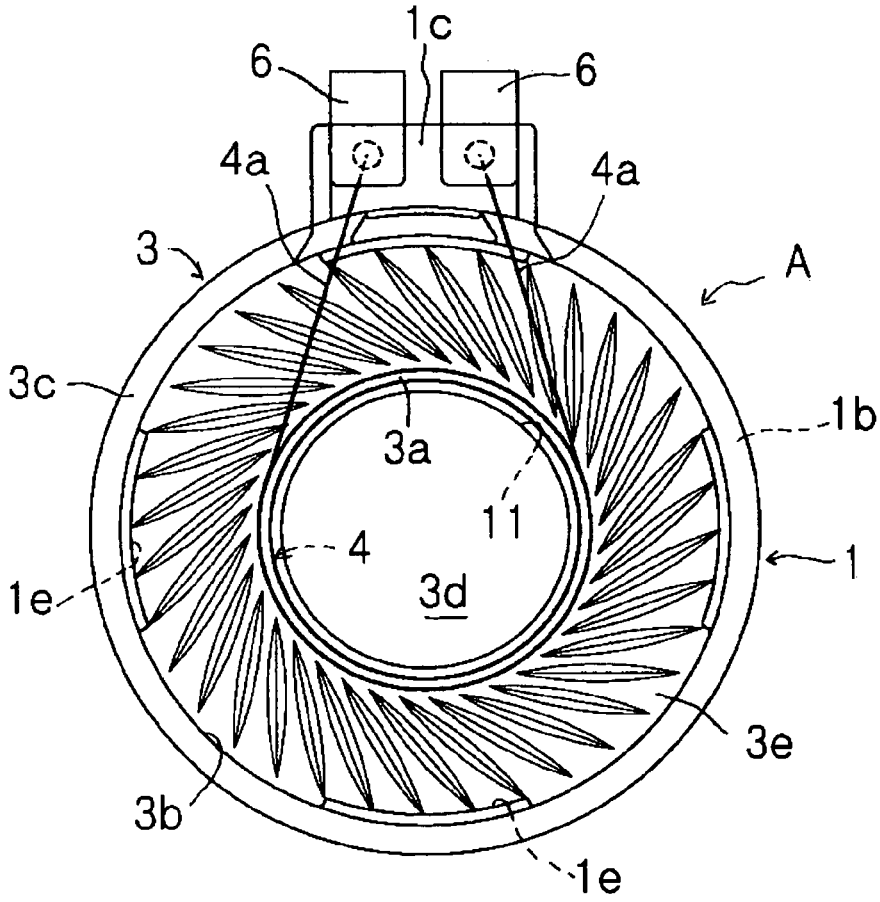
FIG. 2 is a reduced top view of the above actuator.
Figure 3:
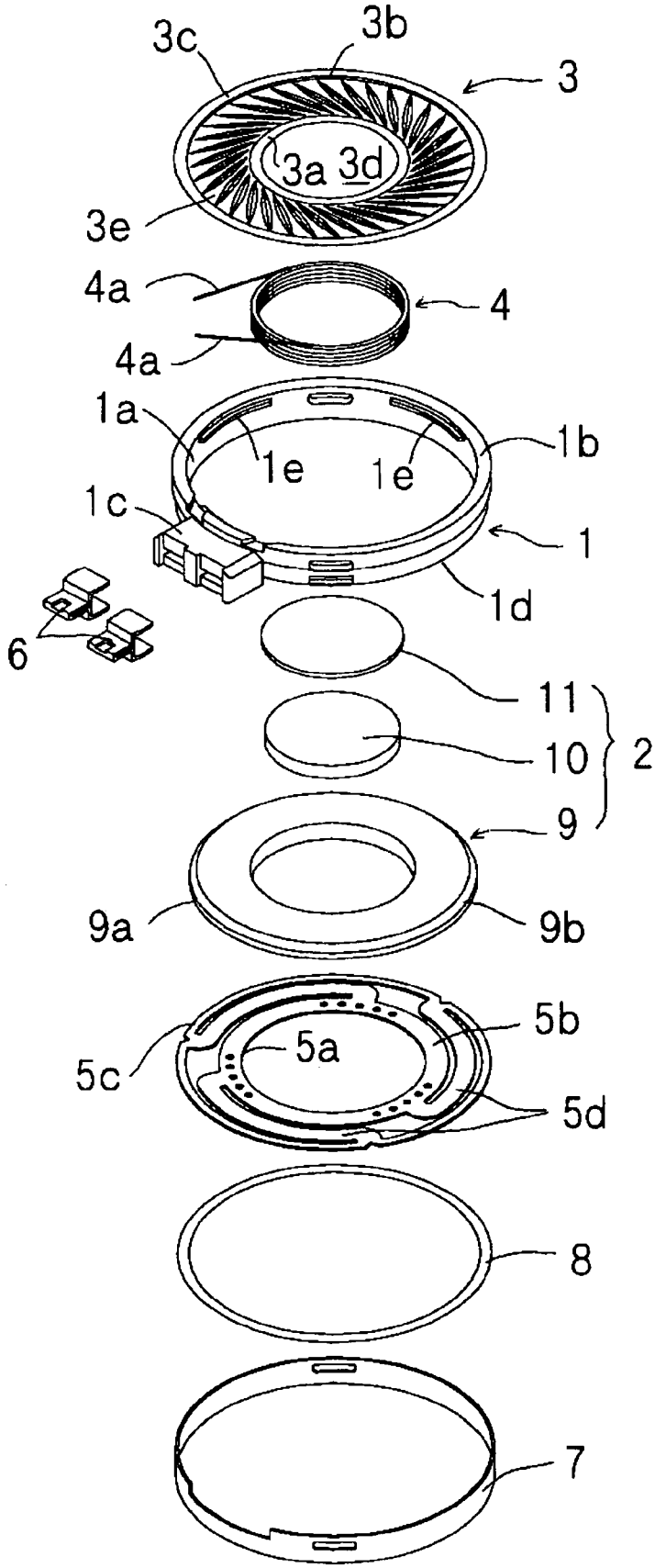
FIG. 3 is an exploded perspective view.
Figure 4:
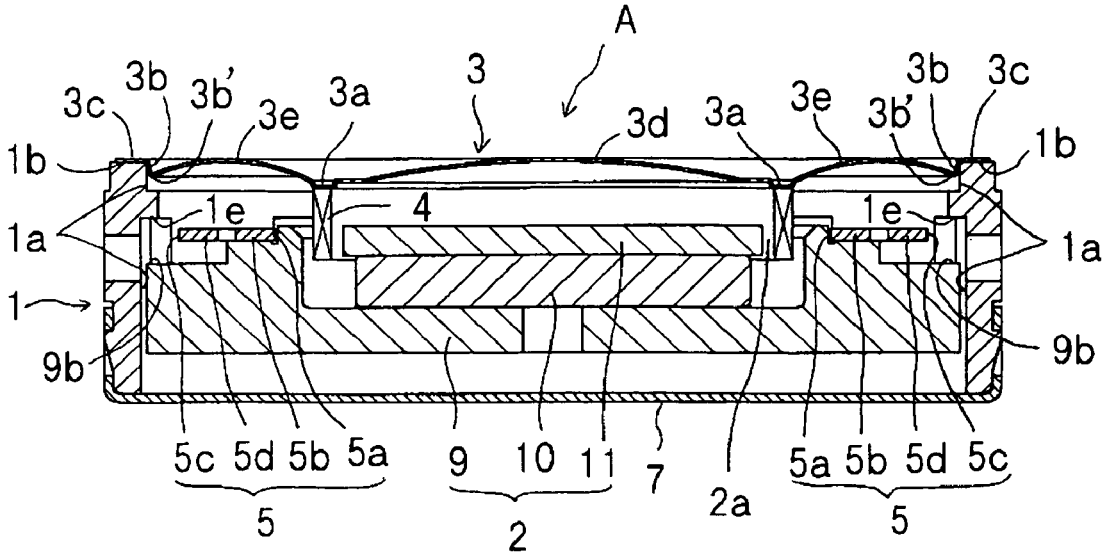
FIG. 4 is a cross-sectional front view of a multifunction-type vibration actuator showing another embodiment according to the invention.

A Multifunction-type vibration actuator
1 Housing
1*a* Inner peripheral surface
1*b* Flat surface
2 Magnetic circuit part
2*a* Magnetic gap
3 Diaphragm
3*b* Rising portion
3*c* Extending portion
4 Voice coil
5 Suspension

The invention claimed is:

1. A multifunction-type vibration actuator, comprising:
a housing,
a magnetic circuit part inside said housing,
a diaphragm arranged facing said magnetic circuit part,
a voice coil fixed to said diaphragm and inserted into a magnetic gap of said magnetic circuit part, and
a suspension for supporting said magnetic circuit part,
wherein an outer periphery of said diaphragm is fixed to an open end of said housing to cover said housing, a portion close to said outer periphery of said diaphragm is bent along an inner periphery of said housing to form a rising portion extending toward said open end, an extending surface extending outward along a flat surface formed at said open end of said housing from said rising portion is formed by bending, and only said flat surface of said housing and said extending surface of said diaphragm are arranged and bonded so as to be parallel while facing each other.

2. A mobile terminal device incorporating said multifunction-type vibration actuator according to claim 1, wherein a received call-out signal initiates vibration of one or both mechanical vibration systems including said diaphragm, said magnetic circuit part and said suspension, vibration of said mechanical vibration systems is transmitted throughout said device through said housing, and reset of said call-out signal stops vibration of said diaphragm and said mechanical vibration systems.

* * * * *

UNITED STATES PATENT AND TRADEMARK OFFICE

CERTIFICATE OF CORRECTION

PATENT NO. : 7,529,380 B2
APPLICATION NO. : 10/592957
DATED : May 5, 2009
INVENTOR(S) : Minoru Ueda et al.

It is certified that error appears in the above-identified patent and that said Letters Patent is hereby corrected as shown below:

On The Cover Page:

(73) Assignee should read: NAMIKI SEIMITSU HOUSEKI KABUSHIKI KAISHA, Tokyo (JP)

Signed and Sealed this

Twenty-third Day of March, 2010

David J. Kappos

David J. Kappos
*Director of the United States Patent and Trademark Office*